US007473322B2

(12) United States Patent
Hickland, Jr. et al.

(10) Patent No.: US 7,473,322 B2
(45) Date of Patent: Jan. 6, 2009

(54) METHOD OF TREATING THE COVERSTOCK OF A BOWLING BALL TO IMPROVE PERFORMANCE

(75) Inventors: Ronald I. Hickland, Jr., Hopkinsville, KY (US); Randell R. Teitloff, Hopkinsville, KY (US)

(73) Assignee: Ebonite International, Inc., Hopkinsville, KY (US)

( * ) Notice: Subject to any disclaimer, the term of this patent is extended or adjusted under 35 U.S.C. 154(b) by 1014 days.

(21) Appl. No.: 10/619,811

(22) Filed: Jul. 15, 2003

(65) Prior Publication Data

US 2005/0011542 A1 Jan. 20, 2005

(51) Int. Cl.

| | |
|---|---|
| ***B08B 7/00*** | (2006.01) |
| ***C11D 3/12*** | (2006.01) |
| ***C11D 3/382*** | (2006.01) |
| ***C11D 3/384*** | (2006.01) |

(52) U.S. Cl. ..... 134/6; 134/7; 510/344; 510/462; 510/466

(58) Field of Classification Search ..... 134/40, 134/42, 8, 10, 6, 7; 510/344, 460, 46, 466, 510/462, 428

See application file for complete search history.

(56) References Cited

U.S. PATENT DOCUMENTS

| | | | | | |
|---|---|---|---|---|---|
| 2,690,581 | A | * | 10/1954 | Di Gesare | 15/210.1 |
| 3,758,912 | A | * | 9/1973 | Shibuya et al. | 15/302 |
| 5,660,751 | A | * | 8/1997 | O'Rorke et al. | 219/411 |
| 5,811,763 | A | * | 9/1998 | O'Rorke | 219/411 |
| 5,944,912 | A | * | 8/1999 | Jenkins et al. | 134/40 |

* cited by examiner

*Primary Examiner*—Michael Barr
*Assistant Examiner*—Saeed T Chaudhry
(74) *Attorney, Agent, or Firm*—Cook Alex Ltd.

(57) ABSTRACT

A method for removing plasticizers, oils and other liquids concentrated in areas contiguous to the outer surface of a coverstock of a bowling ball. The method includes the steps of formulating a plasticizer absorbent material; applying the formulated plasticizer absorbing material to the outer surface of the coverstock; allowing the applied plasticizer absorbing material to remain in contact with the outer surface of the coverstock for a defined time period and removing the plasticizer absorbing material and the extracted plasticizer from the coverstock. The plasticizer absorbing material is formulated of one or more of fine soft pine wood dust, silica gel and sphagnum peat moss and or synthetic or natural microfiber material.

24 Claims, 1 Drawing Sheet

METHOD OF TREATING THE COVERSTOCK OF A BOWLING BALL TO IMPROVE PERFORMANCE

BACKGROUND AND SUMMARY OF THE INVENTION

In the sport of bowling, the angle at which a bowling ball strikes the head pin is an important factor in its effect on the pins, that is, the number of pins knocked down by the bowling ball. Proficient bowlers prefer a bowling ball that consistently describes a curve or "hook" as it approaches the pins. If the hook of the ball begins too soon or too late as the ball moves down the lane towards the pins, what is called the hook effect changes and the ability of the ball to knock down a maximum number of pins may be diminished.

Of particular importance is the ability of the ball to hook near the end of the bowling lane in front of the pins when the ball is thrown with a spin. A bowling ball that hooks well is highly desirable since it gives the bowler an advantage over competing bowlers. Modern bowling balls are formed with a center core of a plastic composition material surrounded by a coverstock which is usually formed of a polyurethane. The polyurethane contains a plasticizer which is the most important component contributing to the ability of the bowling ball to hook. Most of the lanes on which bowling is conducted are oiled at least in the area where the bowling ball first engages the lane after it is released by the bowler. It has been generally believed in the bowling community that oil applied to the lanes is absorbed by the bowling ball and that this absorption of oil into the coverstock of the bowling ball reduces the hooking effect of the bowling ball. Efforts in the bowling community to restore the hooking effect of a bowling ball have been directed primarily to the removal of the absorbed lane oil from the bowling ball, particularly removing oil from the coverstock of the bowling ball. Such efforts proposed by the bowling community have been as extreme as heating the bowling ball to drive off the absorbed oil or treating the coverstock with harmful or dangerous chemicals.

It has been discovered that the degradation of the performance of a bowling ball that is, the reduction in its ability to hook properly because of continued play of the bowling ball on oiled lanes, is not due solely to the absorption of oil as has been conventional wisdom in the bowling community but is due to the concentration of plasticizers in areas of the bowling ball contiguous to the outer surface of the coverstock. It has been discovered the plasticizer in the coverstock concentrates in microchannels which are formed near the outer surface of the porous coverstock as the bowling ball originally engages and continues in ever changing contact with the lane as the ball rolls down the lane. This contact between the bowling ball and the lane forms concentrations of plasticizers in localized areas of the coverstock.

SUMMARY OF THE INVENTION

A principal object of this invention is to improve the degraded hooking performance of a bowling ball which has been played on lanes by removing concentrations of plasticizers in areas of the coverstock contiguous to the outer surface thereof.

Another object of this invention is to improve the hooking performance of a bowling ball without damaging the bowling ball or shortening its useful life.

Still another object of this invention is to improve the hooking performance of a bowling ball without the necessity of exposing the bowling ball to high temperatures.

Yet another object of this invention is to improve the performance of a bowling ball without the need to expose the bowling ball to harmful or dangerous chemicals.

Other objects of the invention will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
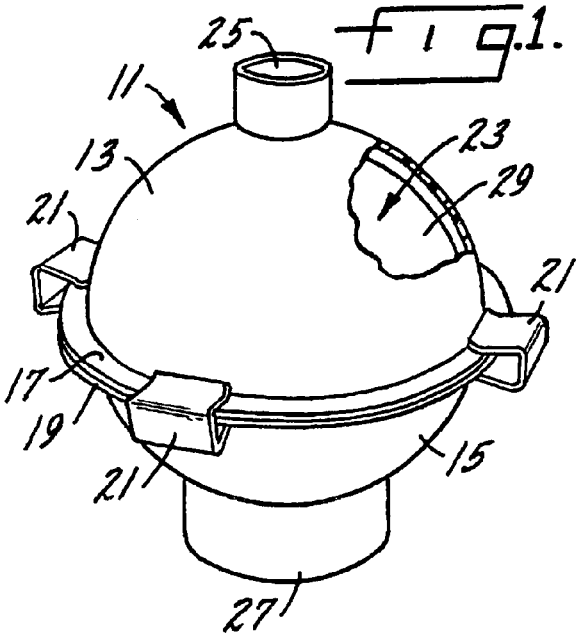
FIG. 1 is a perspective view, with a portion broken away and other portions omitted for clarity of the illustration, of a pair of hemispherical containers clamped together to receive and treat a bowling ball in accordance with the teachings of this invention.
Figure 2:
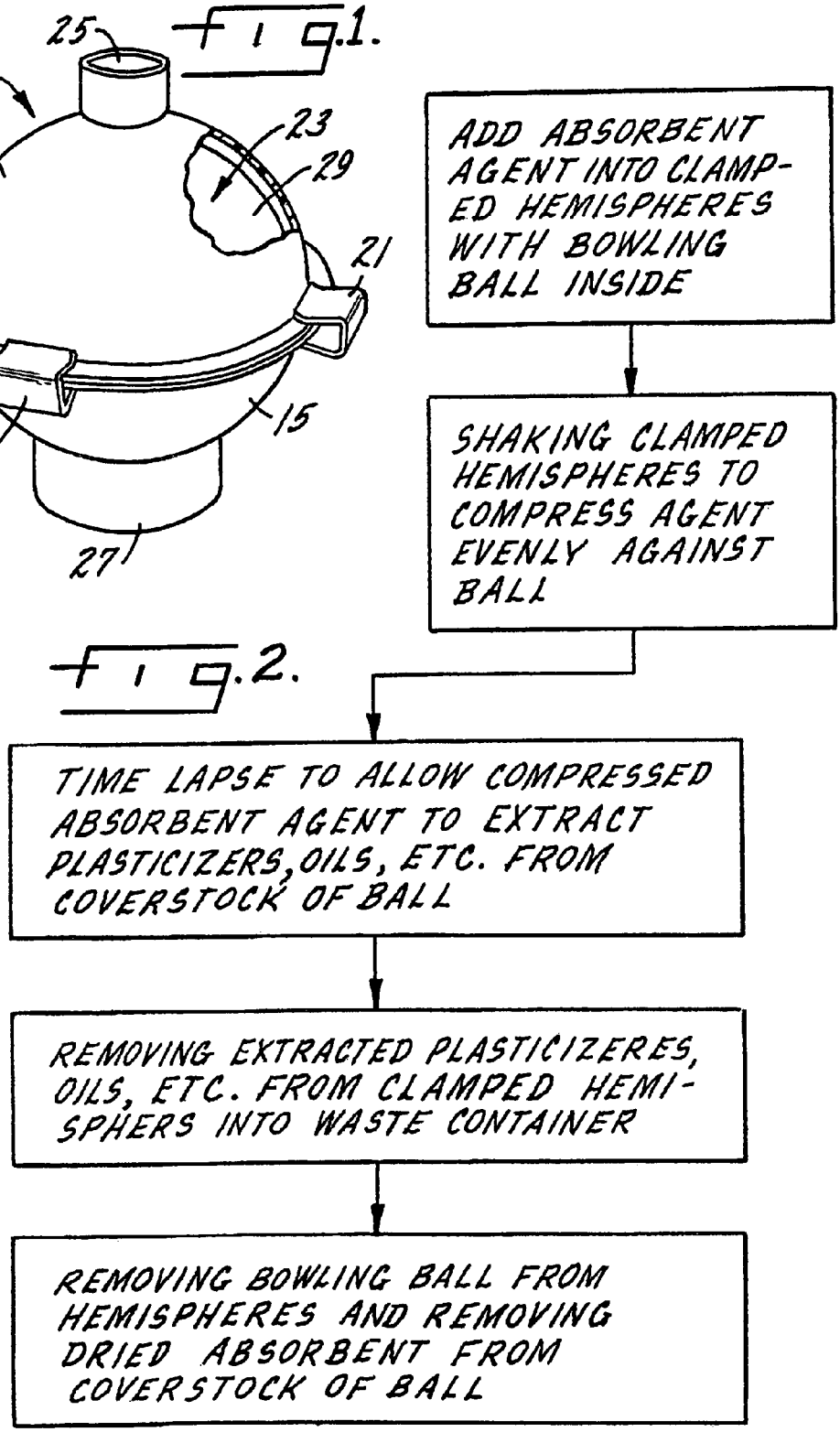
FIG. 2 is a schematic block diagram flow chart showing the steps of the method of this invention.

A chamber 11, for practicing the method of this invention is shown more or less diagrammatically in FIG. 1 of the drawings. The chamber consists of upper and lower hemispherical containers 13 and 15, respectively, with each hemispherical container having an equatorial extending flange 17 and 19, respectively, adapted to receive clamps 21 to hold the hemispherical containers together while a bowling ball 23 is supported in the lower hemispherical container 15. Each hemispherical container is formed of a thin walled plastic which may be transparent or translucent. The upper hemispherical container 13 is formed with an integral filling tube 25 at its top and the lower hemispherical container 15 is formed with an integral tubular support base 27. Radial extending support ribs may be formed inside the lower hemispherical container 15 to support the bowling ball when it is inserted therein, but these ribs are not shown in the drawings for clarity of illustration. Radially extending strengthening ribs may also be formed in the tubular support base 27 but again, these ribs are not depicted for clarity of illustration.

Although the chamber 11 as heretofore shown and described constitutes the best mode of apparatus for practicing the method of this invention, it should be understood and appreciated that other apparati may be used to practice the method of this invention.

It has been discovered that the diminishing hooking potential of a bowling ball as it is played constantly on a bowling lane, is due to the formation of concentrations of plasticizers in localized areas of the coverstock 29 of the bowling ball 23 and is not due to the absorption of oil which is applied to the bowling lanes. Additionally, it has been discovered that the concentrated plasticizers can be removed from the coverstock of the bowling ball without damaging the bowling ball and without exposing the bowling ball to extreme heat and/or dangerous or harmful chemicals.

The first step of the method of the invention is to formulate a substance or mixture of materials that can be applied to the outer surface of the coverstock 29 of a bowling ball 23 and which will extract plasticizers, oil and other liquids including water from the areas of the coverstock in which the plasticizers have been concentrated due to contact of the coverstock with the surface of a bowling lane. It should be understood that the invention is not limited to the use of the absorbent materials, or combinations thereof listed below because it is believed that other absorbents may be used. At the present, the preferred absorbent is a mixture of the following materials however, any one of these materials may be used alone or in combinations of two of these materials to provide a suitable absorbent for use in practicing the method of this invention. These absorbents are:

a) fine soft pine wood dust;

b) silica gel; and c) dried sphagnum peat moss.

The fine, soft pine dust may vary in particle size but a range of sizes from 100 to 500 microns has been found to be satisfactory. The silica gel particles should be as small as possible with particles of approximately 100 microns in size functioning satisfactorily. Peat moss of the type which is commonly available commercially may be used. This peat moss may be artificially heated or air dried by the supplier. Other microfiber materials may also be used as the absorbent.

In the next step of the method of this invention, a bowling ball 23 is positioned in the lower hemispherical container 15, the upper hemispherical container 13 is positioned on the lower hemispherical container with their respective flanges 17 and 19 in engagement. Clamps 21 are engaged with the flanges 17, 19 of the upper hemispherical container 13 and lower hemispherical container 15 to hold the hemispherical containers together. One or a mixture of two or more of the absorbent materials previously listed is then poured through the filling tube 25 to cover the upper portion of the bowling ball and to partially fill the lower hemispherical container 15.

The clamped hemispherical containers 13 and 15 are then shaken to rock the bowling ball side to side in the clamped hemispheres which action compresses the absorbent against the outer surface of the coverstock 29 of the bowling ball 23. Because of the nature of the absorbent and the plasticizer concentrated in areas of the coverstock of the bowling ball as well as absorbed oil in the surface of the bowling ball, the absorbent material will adhere to the coverstock forming an absorbent layer of somewhat uniform thickness covering the outer surface of the coverstock of the bowling ball.

The absorbent agent coated bowling ball is retained in the clamped hemispherical containers for a predetermined period of time, which can be as long as 24 hours, during which time the plasticizers, oils and other liquids in the coverstock of the bowling ball are absorbed by the absorbent material. This predetermined period of time may vary depending upon the amount of plasticizer and other liquids which are contained in the coverstock of the bowling ball.

At the conclusion of the plasticizer absorbing time period, the plasticizer, oil and other liquids that have been collected in the absorbent can be poured out through the filling tube 25 into a suitable container for either collection or disposal.

The clamped hemispherical containers 13 and 15 are then taken apart by removing the clamps 21 so that the absorbent coating on the bowling ball can be removed. Upon removal of this coating, the bowling ball is in condition for use with its hooking potential restored.

The invention claimed is:

1. A method for removing liquids such as plasticizers and oils concentrated in areas contiguous to the outer surface of a coverstock of a bowling ball, said method including the steps of:

formulating a dry flowable plasticizer absorbent material which absorbs plasticizers, oils and other liquids found in the coverstocks of bowling balls, applying said plasticizer absorbent material to said outer surface of said coverstock, allowing said applied plasticizer absorbent material to remain in contact with said outer surface of said coverstock for a defined time period, and removing said plasticizer absorbent material and the extracted plasticizers, oils and other liquids from said coverstock.

2. The method of claim 1 in which said plasticizer absorbent material is formulated by combining fine soft pine wood dust, silica gel and sphagnum peat moss into a mixture.

3. The method of claim 1 in which said plasticizer absorbent material is applied to said outer surface of said coverstock by placing said plasticizer absorbent material against said outer surface of said coverstock.

4. The method of claim 1 in which said applied plasticizer absorbent material is allowed to remain in contact with said outer surface of said coverstock for a time period of up to 24 hours.

5. The method of claim 1 in which said plasticizer absorbent material is formulated by combining silica gel and sphagnum peat moss.

6. The method of claim 1 in which said plasticizer absorbent material is formulated by combining silica gel and fine soft pine wood dust.

7. The method of claim 1 in which said plasticizer absorbent material is formulated by combining fine soft pine wood dust and sphagnum peat moss.

8. The method of claim 1 in which said plasticizer absorbent material is silica gel.

9. The method of claim 1 in which said plasticizer absorbent material is sphagnum peat moss.

10. The method of claim 1 in which said plasticizer absorbent material is fine soft pine wood dust.

11. The method of claim 1 in which said plasticizer absorbent material is microfiber material.

12. A method for removing liquids such as plasticizers and oils concentrated in areas contiguous to the outer surface of a coverstock of a bowling ball, said method including the steps of:

formulating a plasticizer absorbent material comprising silica gel which absorbs plasticizers, oils and other liquids found in the coverstocks of bowling balls, applying said plasticizer absorbent material to said outer surface of said coverstock, allowing said applied plasticizer absorbent material to remain in contact with said outer surface of said coverstock for a defined time period, and removing said plasticizer absorbent material and the extracted plasticizers, oils and other liquids from said coverstock.

13. The method of claim 12 in which said plasticizer absorbent material is formulated by combining fine soft pine wood dust, sphagnum peat moss and said silica gel into a mixture.

14. The method of claim 12 in which said plasticizer absorbent material is applied to said outer surface of said coverstock by placing said plasticizer absorbent material against said outer surface of said coverstock.

15. The method of claim 12 in which said plasticizer absorbent material is allowed to remain in contact with said outer surface of said coverstock for a time period of up to 24 hours.

16. The method of claim 12 in which said plasticizer absorbent material is formulated by combining sphagnum peat moss with said silica gel.

17. The method of claim 12 in which said plasticizer absorbent material is formulated by combining fine soft pine wood dust with said silica gel.

18. A method for removing liquids such as plasticizers and oils concentrated in areas contiguous to the outer surface of a coverstock of a bowling ball, said method including the steps of:

formulating a plasticizer absorbent material comprising sphagnum peat moss which absorbs plasticizers, oils and other liquids found in the coverstocks of bowling balls, applying said plasticizer absorbent material to said outer surface of said coverstock, allowing said applied plasticizer absorbent material to remain in contact with said outer surface of said coverstock for a defined time period, and removing said plasticizer absorbent material and the extracted plasticizers, oils and other liquids from said coverstock.

19. The method of claim 18 in which said plasticizer absorbent material is applied to said outer surface of said coverstock by placing said plasticizer absorbent material against said outer surface of said coverstock.

20. The method of claim 18 in which said plasticizer absorbent material is allowed to remain in contact with said outer surface of said coverstock for a time period of up to 24 hours.

21. The method of claim 18 in which said plasticizer absorbent material is formulated by combining fine soft pine wood dust with said sphagnum peat moss.

22. A method for removing liquids such as plasticizers and oils concentrated in areas contiguous to the outer surface of a coverstock of a bowling ball, said method including the steps of:

formulating a plasticizer absorbent material comprising fine soft pine wood dust which absorbs plasticizers, oils and other liquids found in the coverstocks of bowling balls, applying said plasticizer absorbent material to said outer surface of said coverstock, allowing said applied plasticizer absorbent material to remain in contact with said outer surface of said coverstock for a defined time period, and removing said plasticizer absorbent material and the extracted plasticizers, oils and other liquids from said coverstock.

23. The method of claim 22 in which said plasticizer absorbent material is applied to said outer surface of said coverstock by placing said plasticizer absorbent material against said outer surface of said coverstock.

24. The method of claim 22 in which said plasticizer absorbent material is allowed to remain in contact with said outer surface of said coverstock for a time period of up to 24 hours.

* * * * *